US012303732B2

(12) United States Patent
Lee

(10) Patent No.: US 12,303,732 B2
(45) Date of Patent: May 20, 2025

(54) ASSEMBLED DUMBBELL AND DUMBBELL MAIN BODY THEREOF

(71) Applicant: Chun-Wei Lee, New Taipei (TW)

(72) Inventor: Chun-Wei Lee, New Taipei (TW)

( * ) Notice: Subject to any disclaimer, the term of this patent is extended or adjusted under 35 U.S.C. 154(b) by 149 days.

(21) Appl. No.: 18/457,005

(22) Filed: Aug. 28, 2023

(65) Prior Publication Data

US 2024/0108935 A1 Apr. 4, 2024

(30) Foreign Application Priority Data

Oct. 4, 2022 (TW) ..... 111210853

(51) Int. Cl.
*A63B 21/072* (2006.01)

(52) U.S. Cl.
CPC ..... *A63B 21/0726* (2013.01); *A63B 2225/02* (2013.01)

(58) Field of Classification Search
CPC ..... A63B 21/0726; A63B 2225/02; A63B 21/075; A63B 21/078; A63B 21/0724; A63B 23/12; A63B 21/4043; A63B 21/00065; A63B 21/0728; A63B 21/00061; A63B 21/00069; A63B 21/4035

See application file for complete search history.

(56) References Cited

U.S. PATENT DOCUMENTS 46,413 A * 2/1865 Windshin ..... A63B 21/075 482/108
5,346,449 A * 9/1994 Schlagel ..... A63B 21/0728 482/107
5,464,379 A * 11/1995 Zarecky ..... A63B 21/0728 482/106
5,628,716 A * 5/1997 Brice ..... A63B 21/0728 482/106
5,779,604 A * 7/1998 Towley, III ..... A63B 21/0728 482/107
6,196,952 B1 * 3/2001 Chen ..... A63B 21/0728 482/107
6,602,169 B1 * 8/2003 Patti ..... A63B 21/0728 482/107
7,001,310 B1 * 2/2006 Brice ..... A63B 21/075 482/106
7,413,533 B2 * 8/2008 Lin ..... A63B 21/075 482/106

(Continued)

*Primary Examiner* — Garrett K Atkinson
(74) *Attorney, Agent, or Firm* — Best & Flanagan LLP

(57) ABSTRACT

A dumbbell main body includes two side boards, a connecting shaft, a rotating unit and a fastener. Each of the two side boards includes a containing space, a side-board upper chute, a side-board lower chute, a plurality of fastening holes and two fastening blocks. One of the fastening blocks is located above the other fastening blocks. Two ends of the connecting shaft are respectively connected to the two side boards. The rotating unit includes two rotating rings, four connecting boards, four sliding rods and a horizontal connecting board. The two rotating rings are respectively connected to two ends of the connecting shaft. The four connecting boards are respectively connected to the two rotating rings, wherein two of the connecting boards are located above the other two connecting boards. The four sliding rods are respectively disposed at the four connecting rods.

15 Claims, 16 Drawing Sheets

(56) References Cited

U.S. PATENT DOCUMENTS

| | | | | |
|---|---|---|---|---|
| 7,927,264 | B2 * | 4/2011 | Verheem | A63B 21/0726 482/110 |
| 2006/0105891 | A1 * | 5/2006 | Cappellini | A63B 21/0726 482/106 |
| 2006/0234843 | A1 * | 10/2006 | Chen | A63B 21/075 482/107 |
| 2008/0032874 | A1 * | 2/2008 | Towley | A63B 21/075 482/106 |
| 2011/0312475 | A1 * | 12/2011 | Towley, III | A63B 21/0726 482/107 |
| 2016/0175640 | A1 * | 6/2016 | Kempton | A63B 21/0726 482/106 |
| 2017/0189735 | A1 * | 7/2017 | Buikema | A63B 21/0603 |
| 2020/0398100 | A1 * | 12/2020 | Wang | A63B 21/0726 |
| 2022/0193482 | A1 * | 6/2022 | Wu | A63B 21/0726 |
| 2023/0173328 | A1 * | 6/2023 | Wu | A63B 21/075 482/107 |
| 2023/0264067 | A1 * | 8/2023 | Wang | A63B 21/0726 |
| 2024/0366989 | A1 * | 11/2024 | Hara | A63B 21/075 |

* cited by examiner

ASSEMBLED DUMBBELL AND DUMBBELL MAIN BODY THEREOF

CROSS REFERENCE TO RELATED APPLICATIONS

This application claims priority of Application No. 111210853 filed in Taiwan on Oct. 4, 2022 under 35 U.S.C. § 119, the entire contents of both of which are hereby incorporated by reference.

BACKGROUND OF THE INVENTION

1. Field of the Invention

The present invention relates to an assembled dumbbell and a dumbbell main body thereof, and more particularly, to an assembled dumbbell that does not occupy an overly large space and allows a user to quickly and easily replace weight plates, and a dumbbell main body thereof.

2. Description of the Related Art

Modern people value highly of health and often purchase workout equipment for regular exercise, and dumbbells are one of the most popular types of users. A conventional dumbbell has a fixed weight, and a user can purchase multiple dumbbells of different weights according to own weight-bearing capacity and parts to be trained.

However, purchasing multiple conventional dumbbells having different weights occupy a large space, and causes complications for users without large storage spaces. Thus, manufacturers have launched assembled dumbbells. An assembled dumbbell includes a connecting shaft, a plurality of different weight plates and fastening locks, and has a reduced storage space compared to conventional dumbbells. A user may mount weight plates of a weight to be used to two ends of the connecting shaft according to own weight-t-bearing capacity and parts to be trained, and then lock the weight plates on the two ends by using the fastening locks so as to prevent danger in case the weight plates fall off.

To replace weight plates of different weights when an assembled dumbbell is used, a user needs to first unlock and remove the fastening locks, remove the weight plates of the original weights, mount weight plates of other weights on the two ends of the connecting shaft, and then lock the weight plates on the two ends by using the fastening locks. However, the above process of unlocking and removing the fastening locks and mounting the weight plates may be quite tedious and time consuming.

Therefore, there is a need for a novel assembled dumbbell that does not occupy an overly large space and allows a user to quickly and easily replace weight plates.

SUMMARY OF THE INVENTION

It is a primary object of the present invention to provide a dumbbell main body that does not occupy an overly large space and allows a user to quickly and easily replace weight plates.

To achieve the above object, a dumbbell main body of the present invention includes two side boards, a connecting shaft, a rotating unit and a fastener. Each of the two side boards includes a containing space, a side-board upper chute, a side-board lower chute, a plurality of fastening holes and two fastening blocks, wherein one of the fastening blocks is located above the other fastening block. Two ends of the connecting shaft are respectively connected to the two side boards. The rotating unit includes two rotating rings, four connecting boards, four sliding rods and a horizontal connecting board. The two rotating rings are respectively connected to two ends of the connecting shaft. The four connecting boards are respectively connected to the two rotating rings, wherein two of the connecting boards are located above the other two connecting boards. The four sliding rods are respectively disposed at the four connecting boards, respectively located at the side-board upper chutes and the side-board lower chutes of the two side boards, and respectively connected to the two fastening blocks of the two side boards. Two ends of the horizontal connecting board are respectively connected to the other two connecting boards. The fastener is connected to the horizontal connecting board, and is for fastening with any of the fastening holes.

According to an embodiment of the present invention, the fastener further includes a spring, a baffle, a push piece and protruding column. The baffle is connected to one end of the spring. The push piece is connected to the other end of the spring. The protruding column is connected to the push piece, and is for fastening with any of the fastening holes.

According to an embodiment of the present invention, one of the side boards includes a weight indicator, which is located above the side-board upper chute and is located above one of the connecting boards.

According to an embodiment of the present invention, the weight indicator is a plurality of numerical indications arranged along an arc, wherein a smallest number of the plurality of numerical indications is 0. The plurality of fastening holes are arranged along an arc. Positions of the plurality of the numeral indications correspond to the plurality of fastening holes by regarding the connecting shaft as a center.

According to an embodiment of the present invention, the rotating unit further includes four connecting board chutes, the four connecting board chutes are respectively disposed at the four connecting boards, and the four sliding rods are respectively located in the four connecting chutes.

According to an embodiment of the present invention, one of the connecting boards further includes an indication end, which is directed toward the weight indicator.

According to an embodiment of the present invention, the four connecting plates are parallel to one another.

According to an embodiment of the present invention, when the rotating unit rotates such that the indication end points toward any of the numerical indications of the weight indicator, the rotating unit simultaneously drives the horizontal connecting board to rotate so that the fastener connected to the horizontal connecting plate moves to align with one of the fastening holes, and the fastening hole corresponds, by regarding the connecting shaft as a center, to the any of the numerical indications pointed by the indication end.

According to an embodiment of the present invention, when the rotating unit rotates such that the indication end points to any numerical indication that is non-0 of the weight indicator, the rotating unit simultaneously drives the four sliding rods to respectively move in the side-board upper chutes and the side-board lower chutes of the two side boards, so that the two fastening blocks of the two side boards connected to the four sliding rods extend to the outside from the containing space.

It is another primary object of the present invention to provide an assembled dumbbell that does not occupy an overly large space and allows a user to quickly and easily replace weight plates.

To achieve the above object, an assembled dumbbell of the present invention includes the dumbbell body described above and a first weight adding structure. The first weight adding structure includes two first sidewalls, a first upper connecting board and a first lower connecting board. The first upper connecting board includes two first upper fastening holes, which respectively correspond to two of the fastening blocks located above. The first lower connecting board includes two first lower fastening holes, which respectively correspond to another two of the fastening blocks located below.

According to an embodiment of the present invention, when the dumbbell main body is located between the two first sidewalls and the two fastening blocks of the two side boards extend to the outside from the containing space, the two fastening blocks of the two side boards respectively pass through the two first upper fastening holes of the first upper connecting board and the two first lower fastening holes of the first lower connecting board of the two first sidewalls, such that the dumbbell main body is joined with the first weight adding structure.

According to an embodiment of the present invention, each of the side boards further includes a dumbbell main body foolproof unit, which is located on the outside of the side board. Each of the first sidewalls further includes a first notch, and a position of the first notch corresponds to the dumbbell main body foolproof unit. When the dumbbell main body is joined with the first weight adding structure, the dumbbell main body foolproof unit is located in the first notch.

According to an embodiment of the present invention, the assembled dumbbell further includes a second weight adding structure, which includes two second sidewalls, a second upper connecting board and a second lower connecting board. The second upper connecting board includes two second upper fastening holes, which respectively correspond to two of the upper fastening blocks located above and the two first upper fastening holes. The second lower connecting board includes two second lower fastening holes, which respectively correspond to two of the lower fastening blocks located below and the two first lower fastening holes.

According to an embodiment of the present invention, when the dumbbell main body is located between the two first sidewalls, the first weight adding structure is located between the two second sidewalls; and when the two fastening blocks of the two side boards extend to the outside from the containing space, the two first upper fastening holes and the two first lower fastening holes, the two fastening blocks of the two side boards respectively pass through the two second upper fastening holes of the second upper connecting board and the two second lower fastening holes of the second lower connecting board of the two second sidewalls, such that the dumbbell main body is joined with the first weight adding structure and the second weight adding structure.

According to an embodiment of the present invention, each of the first side boards further includes a first foolproof unit, which is located on the outside of the first sidewall. Each of the second sidewalls further includes a second notch, and a position of the second notch corresponds to the first foolproof unit. When the first weight adding structure and the second weight adding structure are joined, the first foolproof unit is located in the second notch.

DETAILED DESCRIPTION OF THE PREFERRED EMBODIMENT

Preferred specific embodiments are given below to better understand the technical contents of the present invention.

Figure 1:
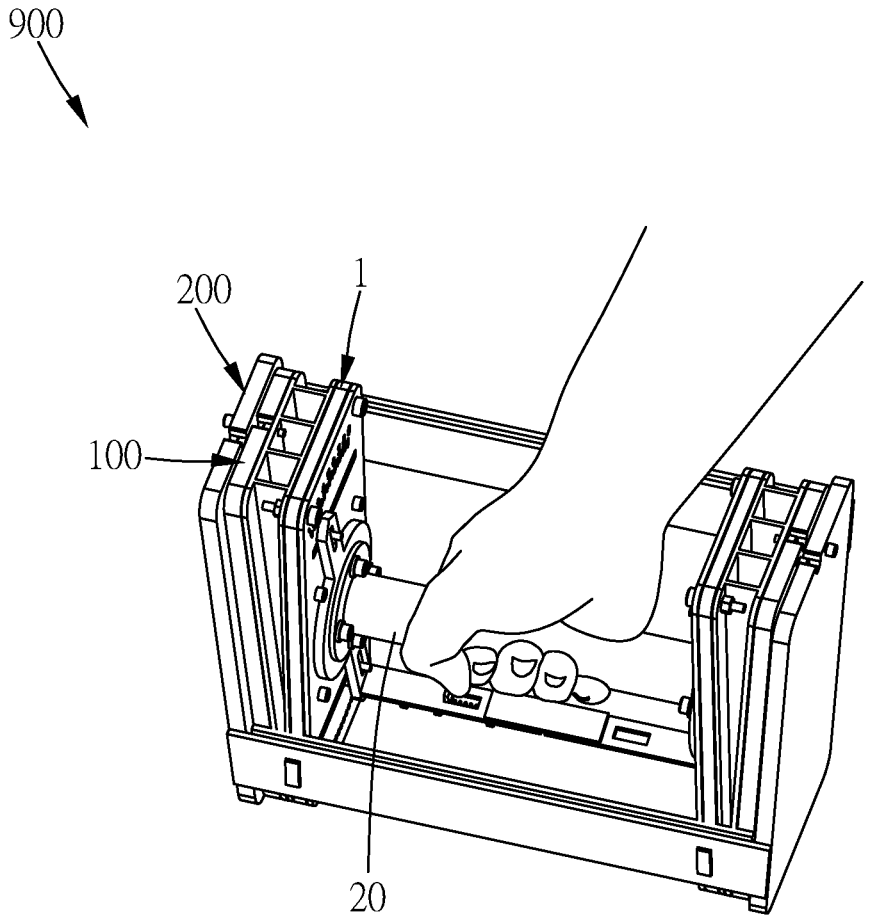
FIG. 1 is a schematic diagram of an assembled dumbbell according to a first embodiment of the present invention.
Figure 2:
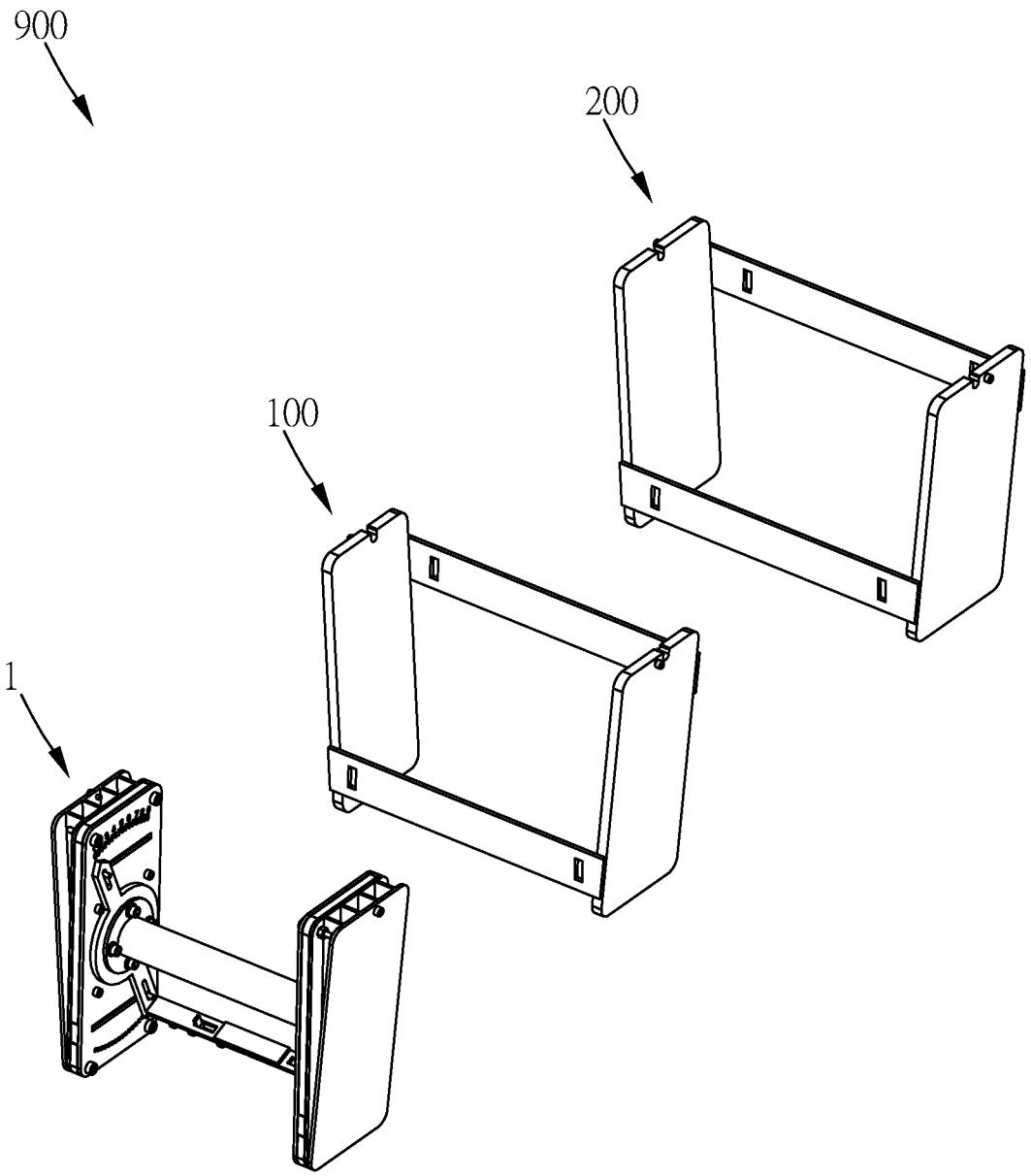
FIG. 2 is an exploded perspective diagram of the assembled dumbbell according to the first embodiment of the present invention.
Figure 3A:
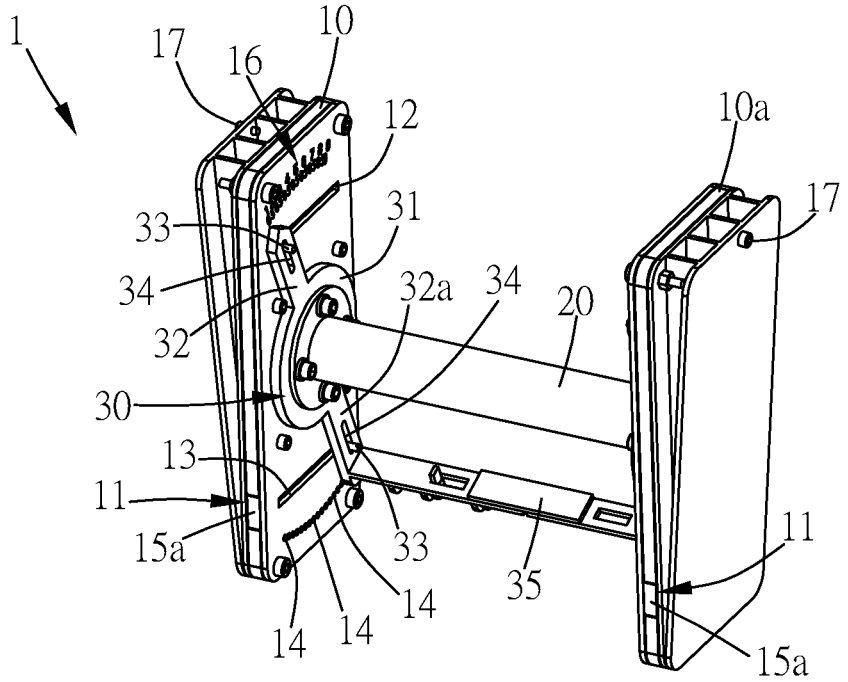
FIG. 3A is a schematic diagram of a dumbbell main body according to the first embodiment of the present invention.
Figure 3B:
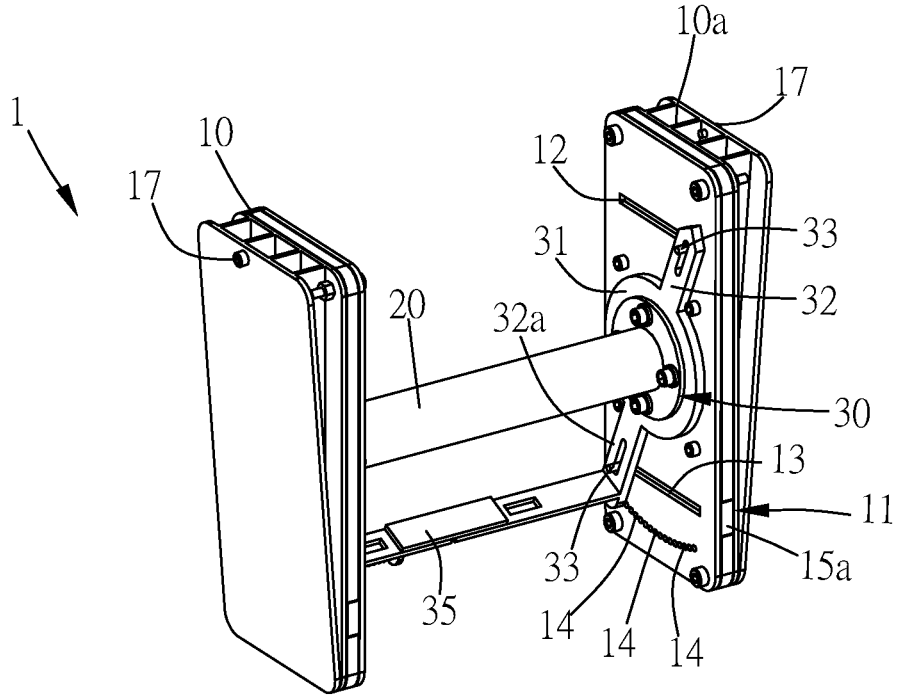
FIG. 3B is a schematic diagram of the dumbbell main body from another angle according to the first embodiment of the present invention.
Figure 4A:
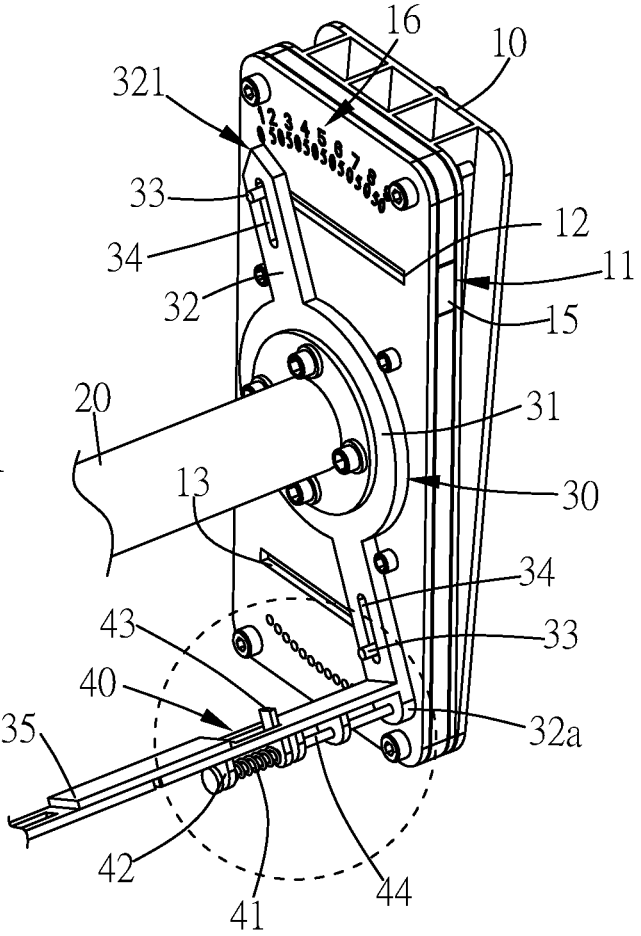
FIG. 4A is a partial schematic diagram a dumbbell main body according to the first embodiment of the present invention.
Figure 4B:
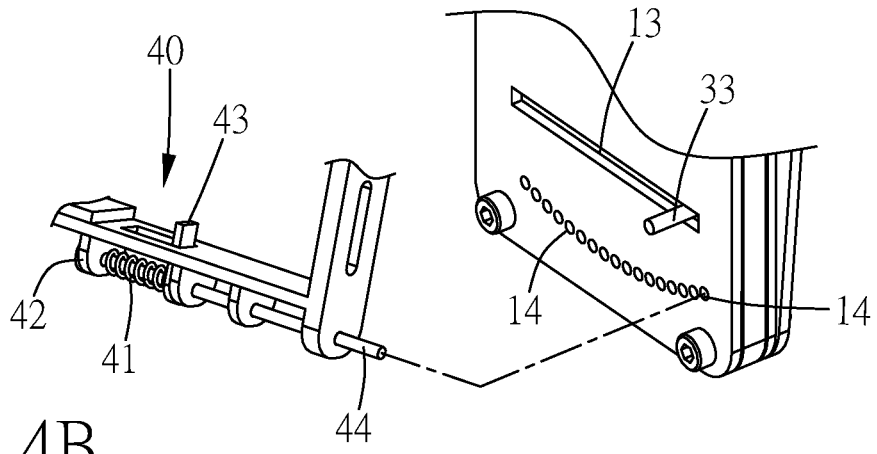
FIG. 4B is a schematic diagram of a fastener and fastening holes according to the first embodiment of the present invention.
Figure 5:
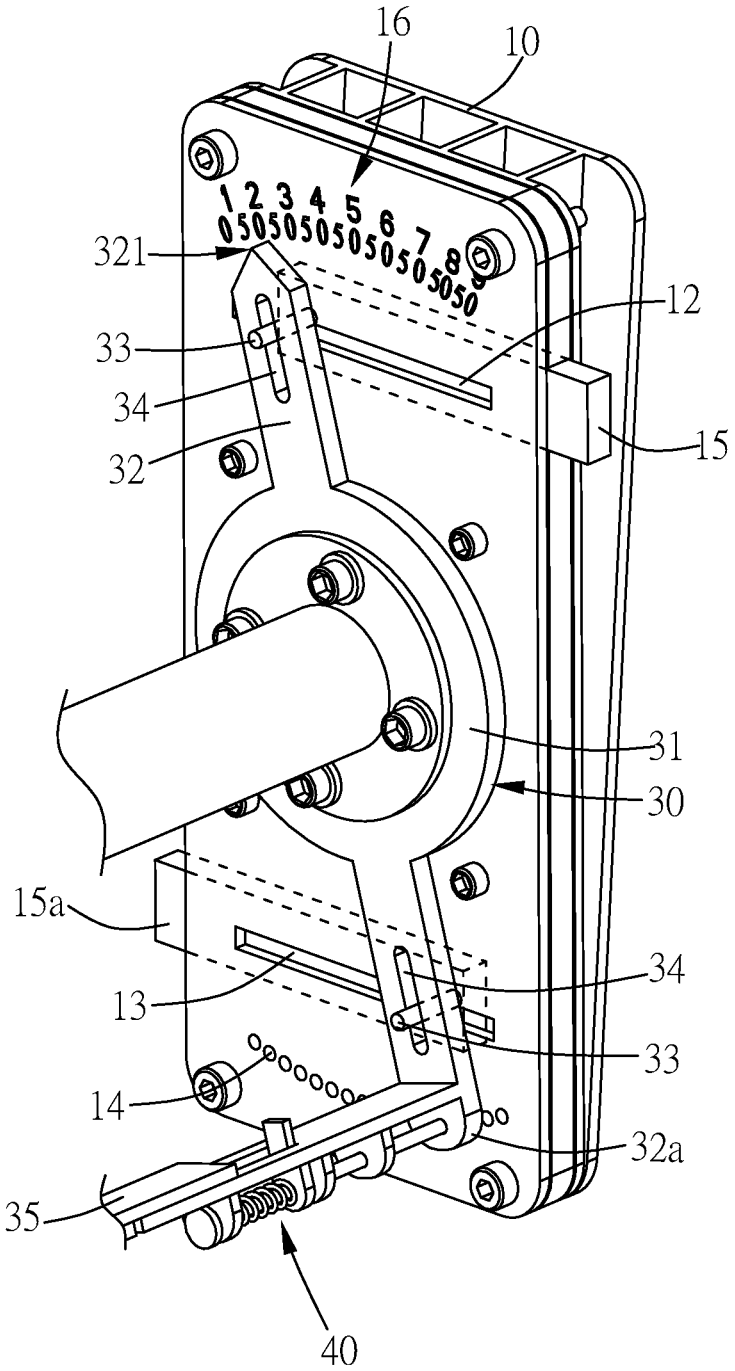
FIG. 5 is a partial schematic diagram of a fastening block of the dumbbell main body extending to the outside from a containing space according to the first embodiment of the present invention.
Figure 6:
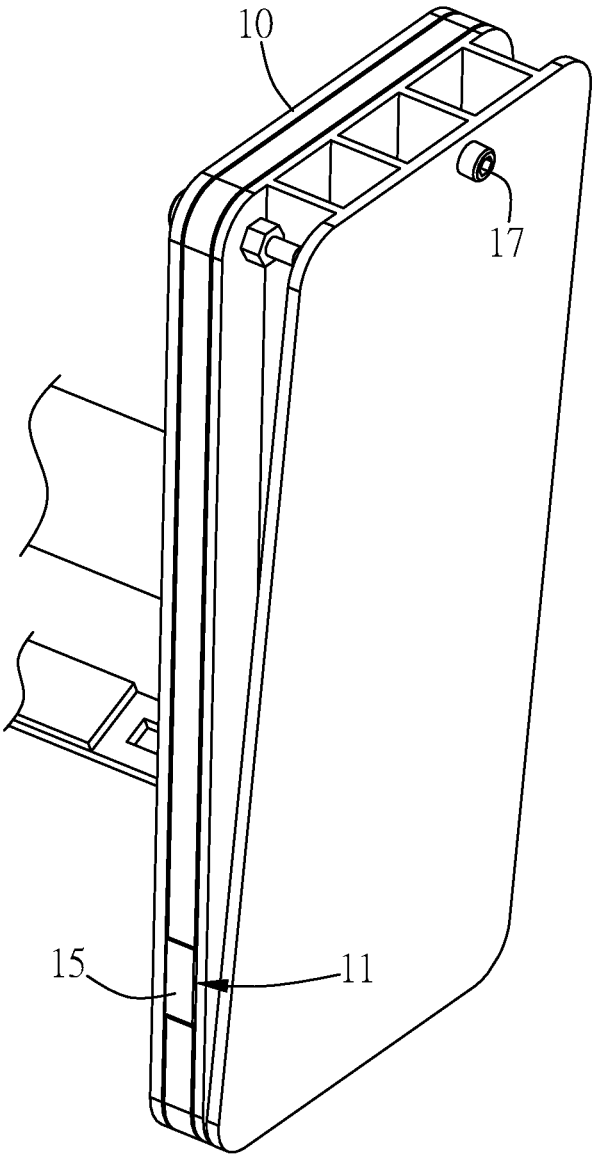
FIG. 6 is a schematic diagram of an outside of a side board of the dumbbell main body according to the first embodiment of the present invention.
Figure 7:
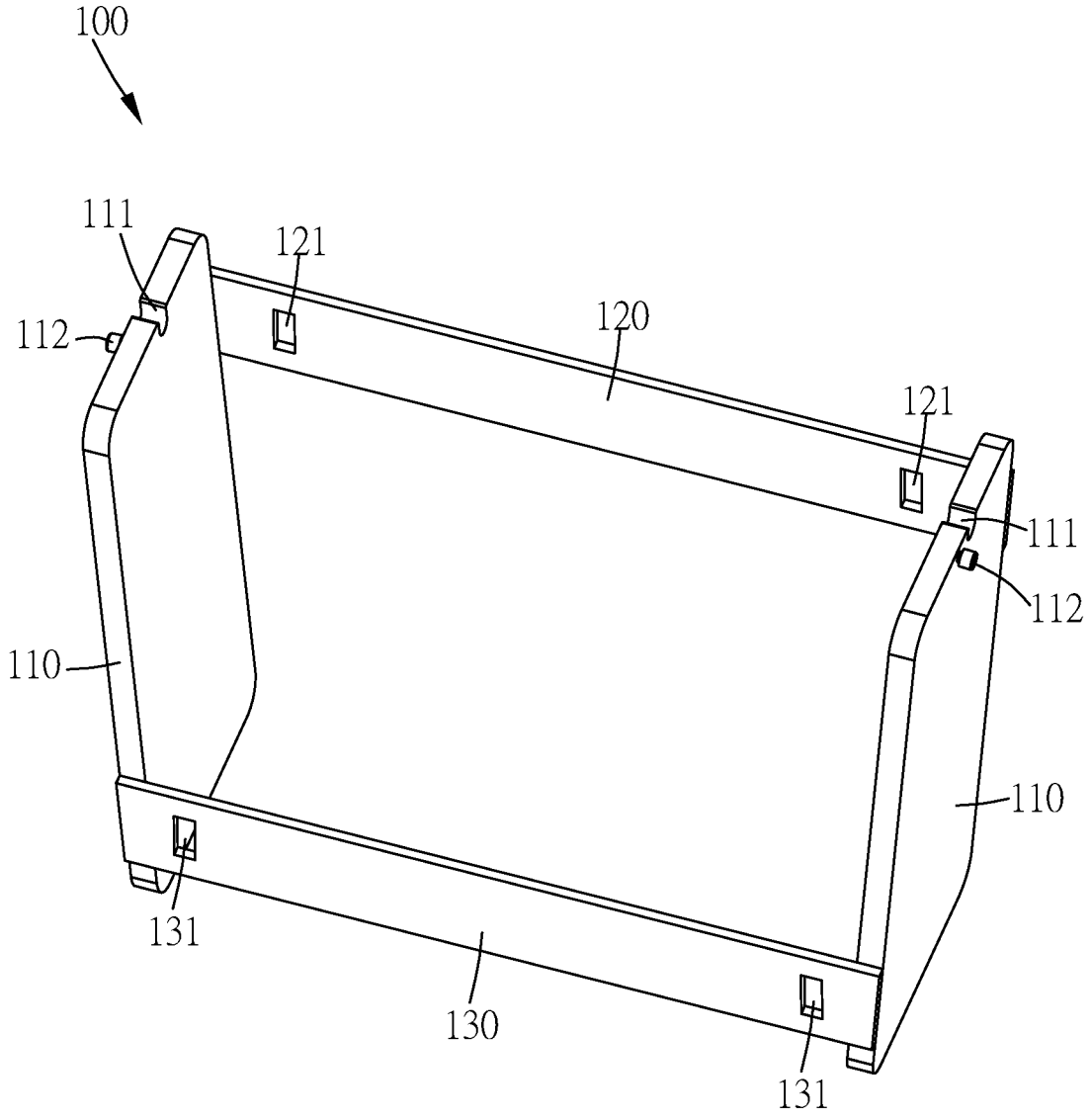
FIG. 7 is a schematic diagram of a first weight adding structure according to a first embodiment of the present invention.
Figure 8:
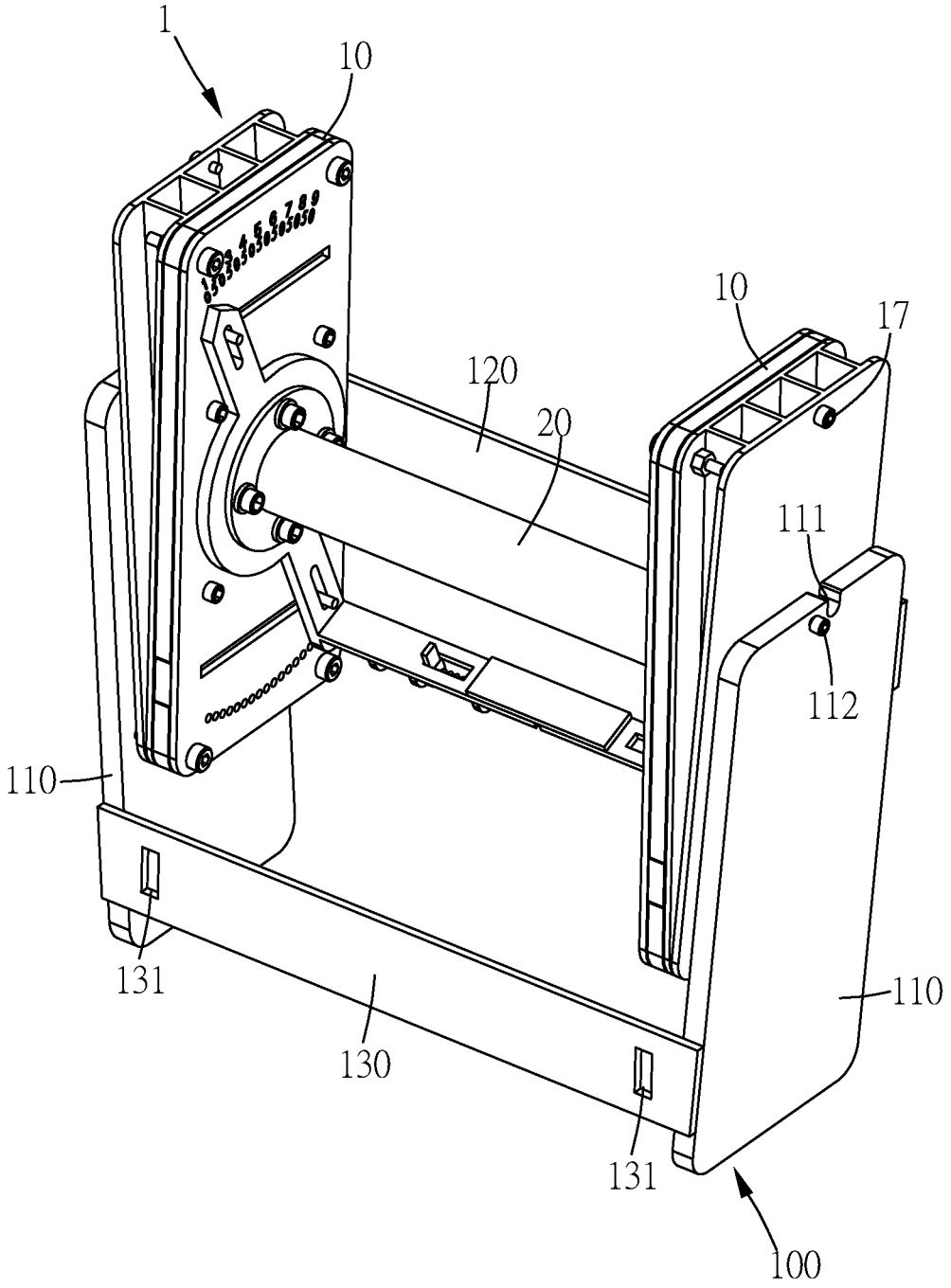
FIG. 8 is a schematic diagram of the dumbbell main body placed in the first weight adding structure according to the first embodiment of the present invention.
Figure 9:
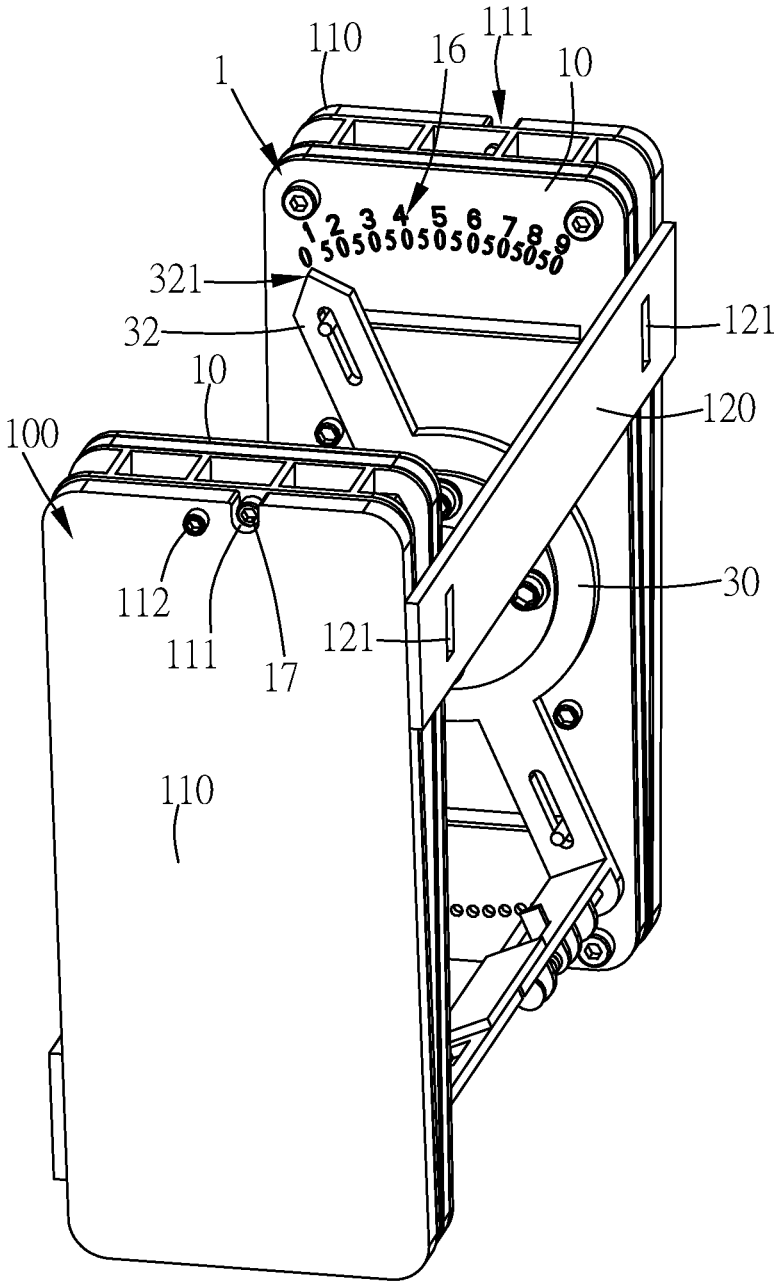
FIG. 9 is a schematic diagram of the dumbbell main body located in the first weight adding structure according to the first embodiment of the present invention.
Figure 10:
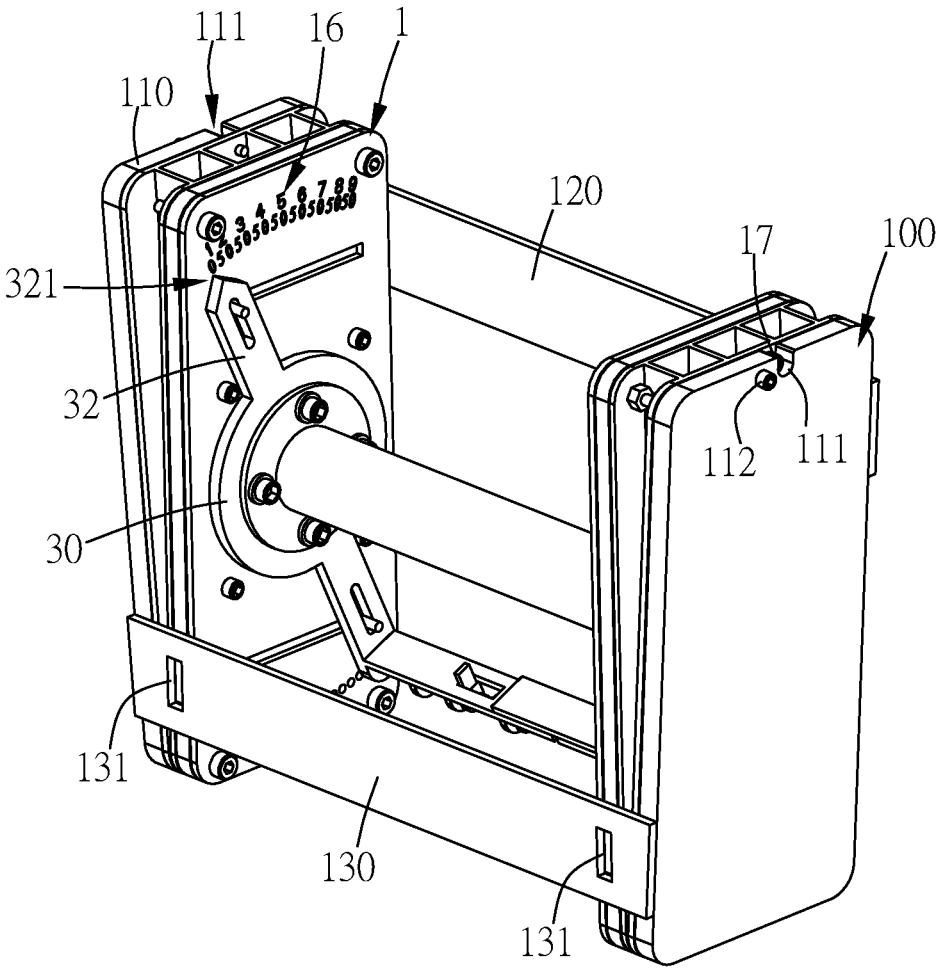
FIG. 10 is a schematic diagram of the dumbbell main body located in the first weight adding structure from another angle according to the first embodiment of the present invention.
Figure 11:
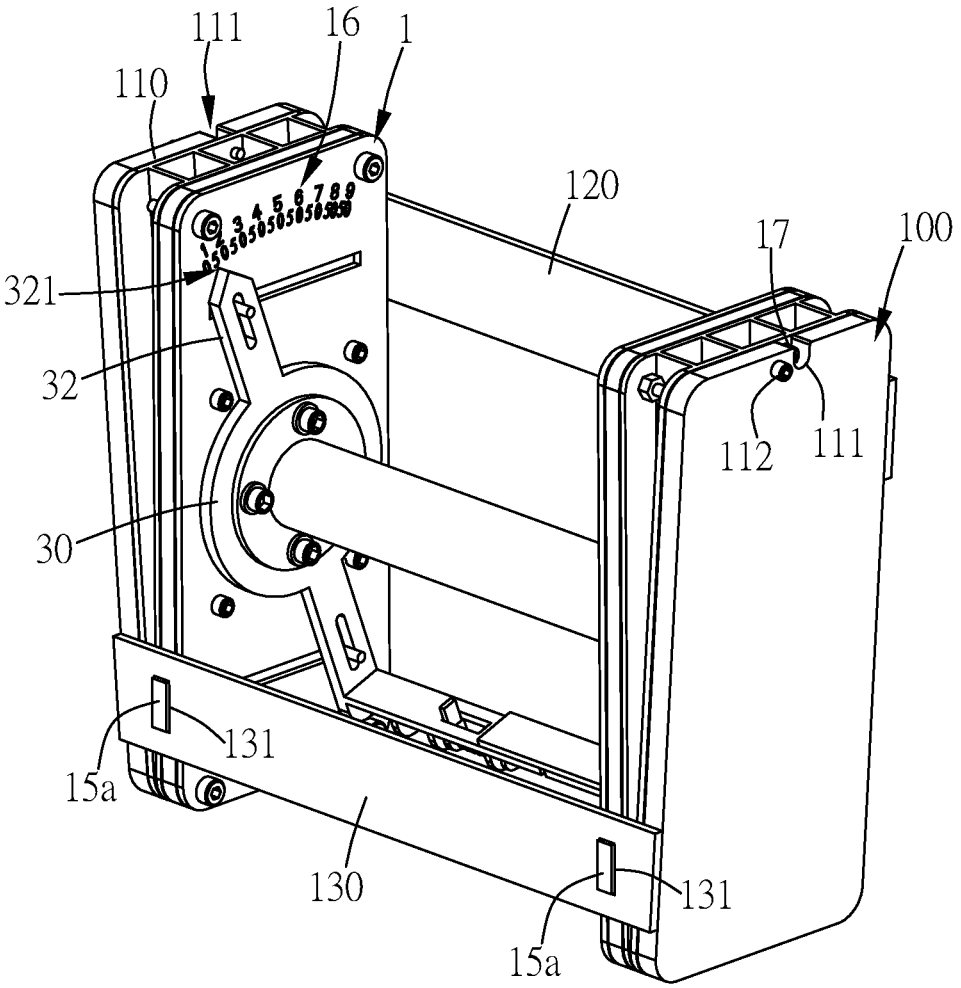
FIG. 11 is a schematic diagram of a fastening block of the dumbbell main body fastened at a first lower fastening hole of the first weight adding structure according to the first embodiment of the present invention.
Figure 12:
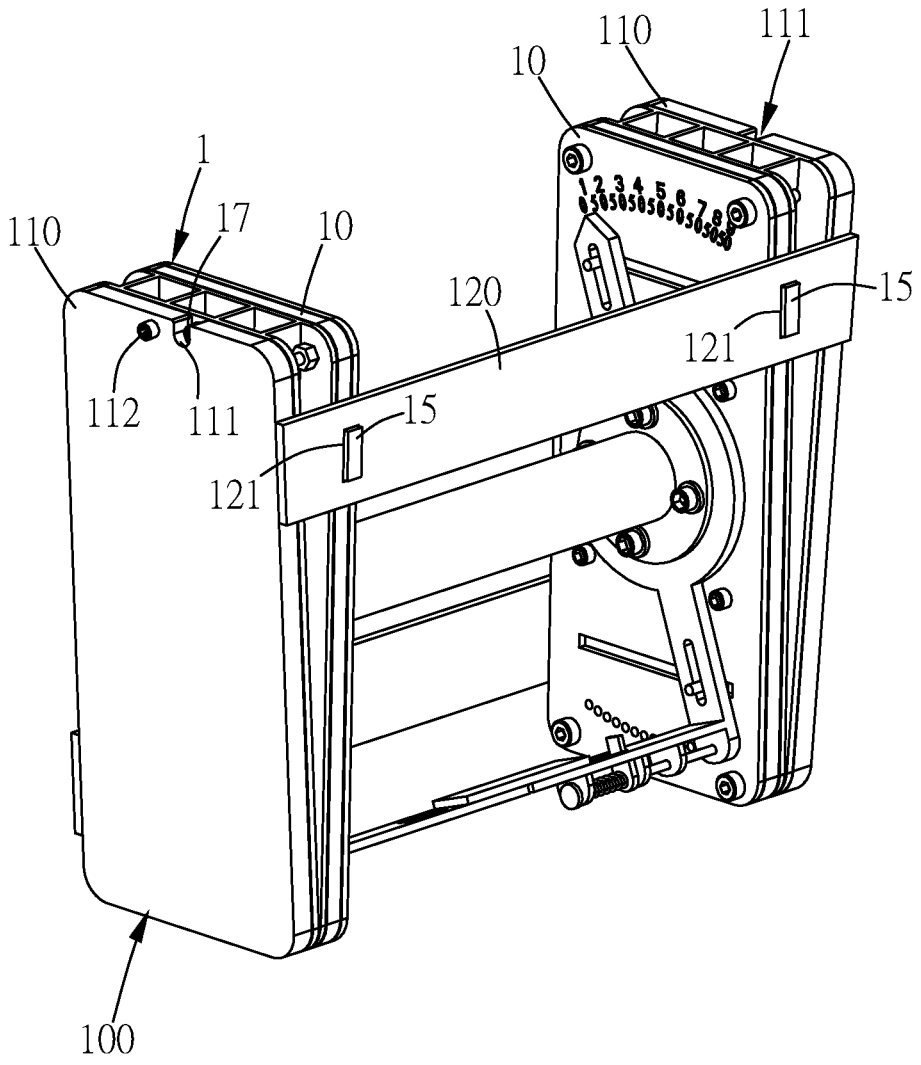
FIG. 12 is a schematic diagram of the fastening block of the dumbbell main body fastened at a first upper fastening hole of the first weight adding structure according to the first embodiment of the present invention.
Figure 13:
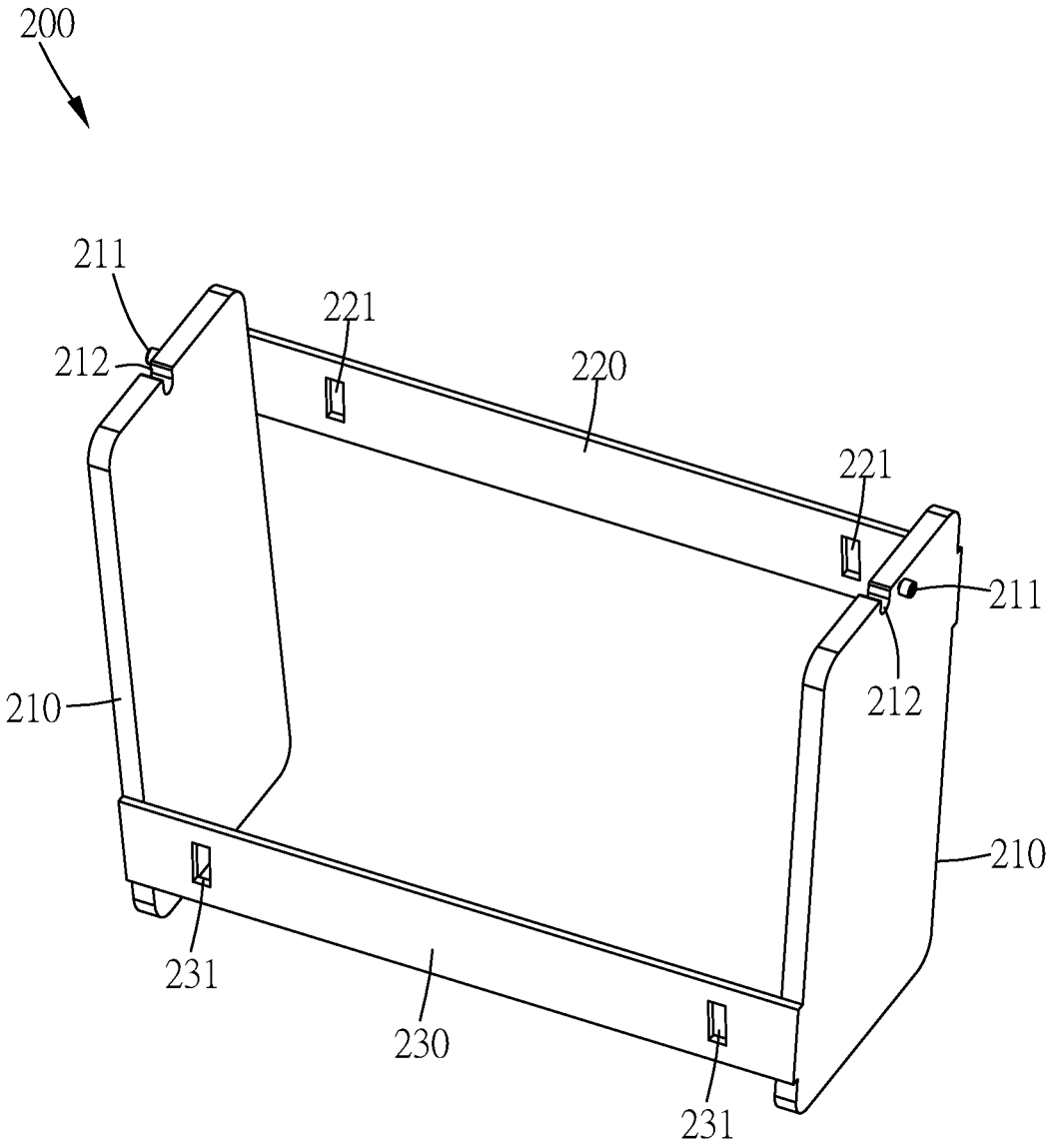
FIG. 13 is a schematic diagram of a second weight adding structure according to the first embodiment of the present invention.
Figure 14:
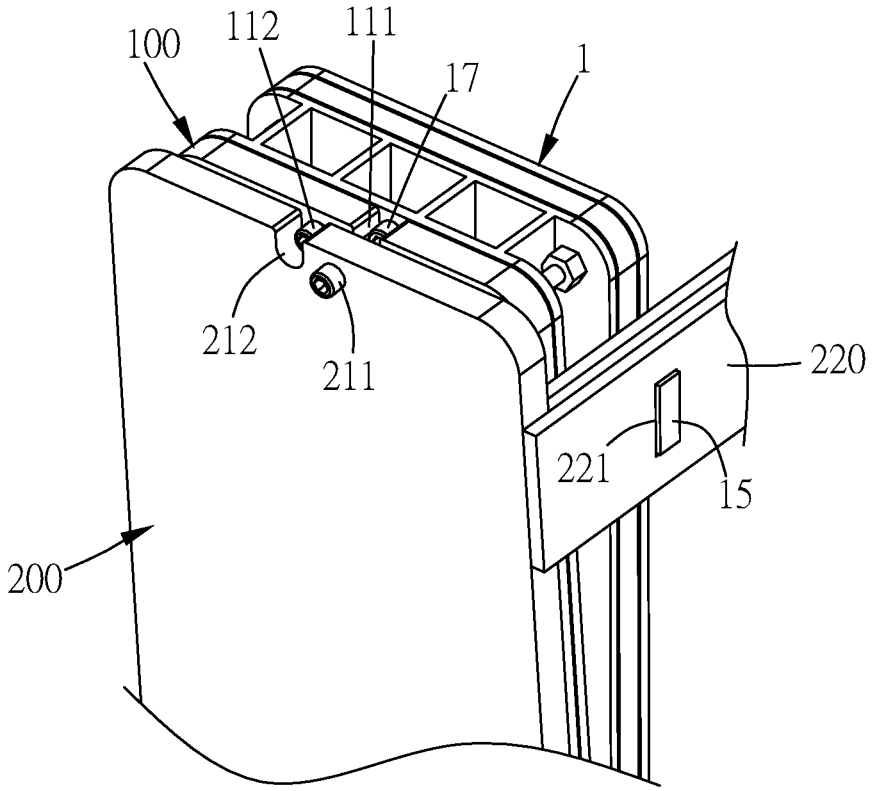
FIG. 14 is a partial schematic diagram of the dumbbell main body, the first weight adding structure and the second weight adding structure that are joined according to the first embodiment of the present invention.
Figure 15:
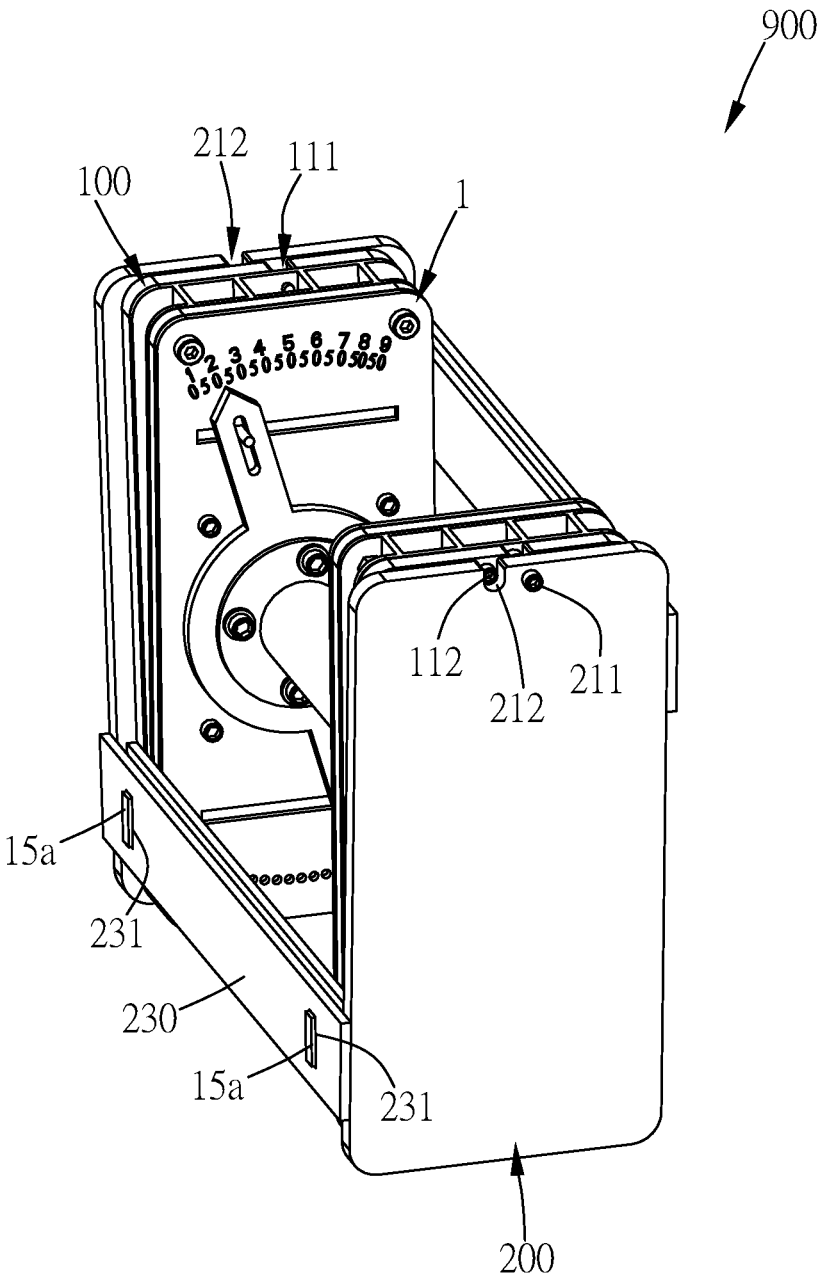
FIG. 15 is a schematic diagram of the fastening block of the dumbbell main body fastened at the first weight adding structure and second lower fastening holes of the second weight adding structure according to the first embodiment of the present invention.
Figure 16:
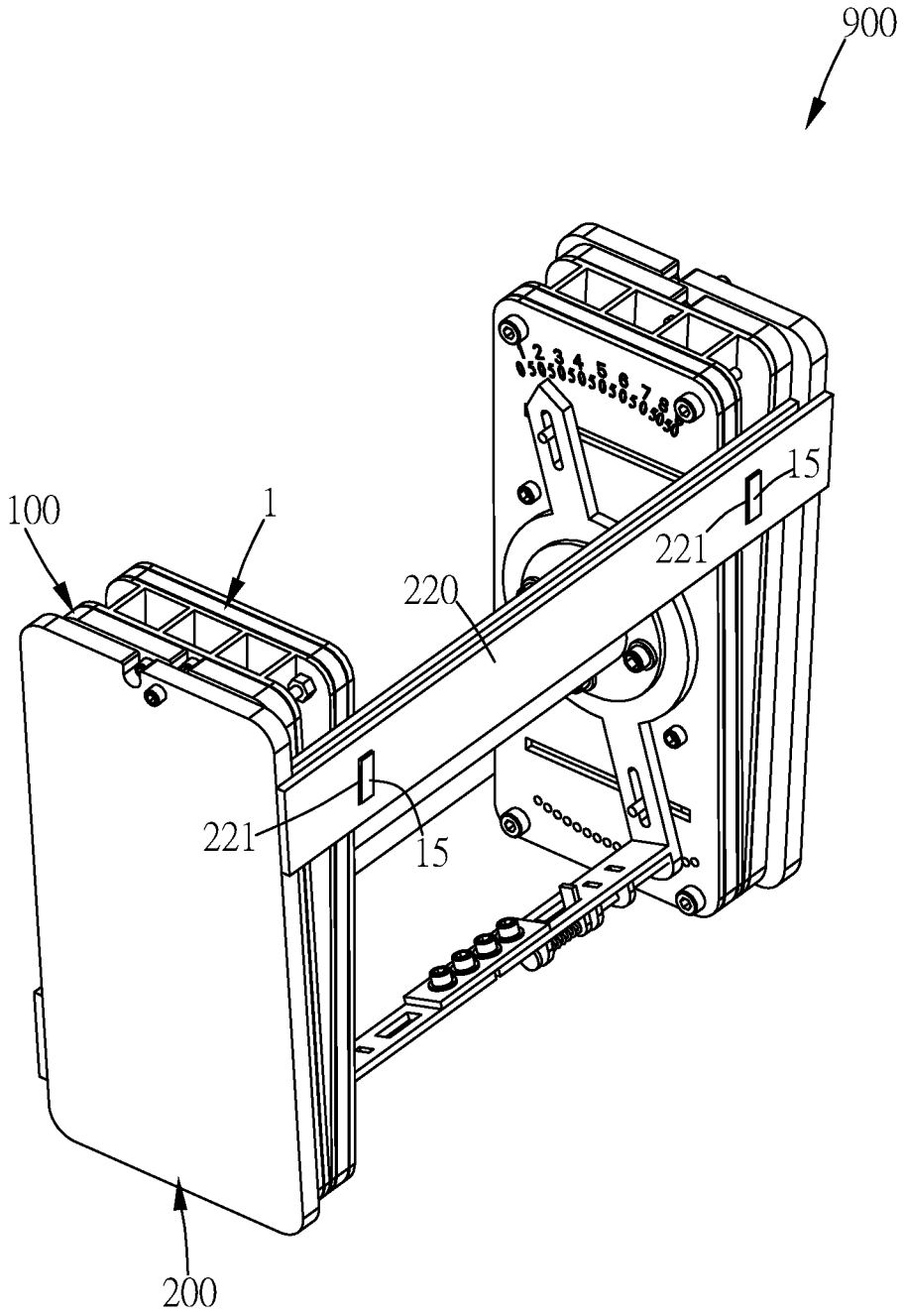
FIG. 16 is a schematic diagram of the fastening block of the dumbbell main body fastened at the first weight adding structure and second upper fastening holes of the second weight adding structure according to the first embodiment of the present invention.

Refer to FIG. 1 to FIG. 16 for description associated with an assembled dumbbell and a dumbbell main body according to a first embodiment of the present invention. FIG. 1 shows a schematic diagram of an assembled dumbbell according to a first embodiment of the present invention. FIG. 2 shows an exploded perspective diagram of the assembled dumbbell according to the first embodiment of the present invention. FIG. 3A shows a schematic diagram of a dumbbell main body according to the first embodiment of the present invention. FIG. 3B shows a schematic diagram of the dumbbell main body from another angle according to the first embodiment of the present invention. FIG. 4A shows a partial schematic diagram the dumbbell main body according to the first embodiment of the present invention. FIG. 4B shows a schematic diagram of a fastener and fastening holes according to the first embodiment of the present invention. FIG. 5 shows a partial schematic diagram of a fastening block of the dumbbell main body extending to the outside from a containing space according to the first embodiment of the present invention. FIG. 6 shows a schematic diagram of an outside of a side board of the dumbbell main body according to the first embodiment of the present invention. FIG. 7 shows a schematic diagram of a first weight adding structure according to a first embodiment of the present invention. FIG. 8 shows a schematic diagram of the dumbbell main body placed in the first weight adding structure according to the first embodiment of the present invention. FIG. 9 shows a schematic diagram of the dumbbell main body located in the first weight adding structure according to the first embodiment of the present invention. FIG. 10 shows a schematic diagram of the dumbbell main body located in the first weight adding structure from another angle according to the first embodiment of the present invention. FIG. 11 shows a schematic diagram of the fastening block of the dumbbell main body fastened at a first lower fastening hole of the first weight adding structure according to the first embodiment of the present invention. FIG. 12 shows a schematic diagram of the fastening block of the dumbbell main body fastened at a first upper fastening hole of the first weight adding structure according to the first embodiment of the present invention. FIG. 13 shows a schematic diagram of a second weight adding structure according to the first embodiment of the present invention. FIG. 14 shows a partial schematic diagram of the dumbbell main body, the first weight adding structure and the second weight adding structure that are joined according to the first embodiment of the present invention. FIG. 15 shows a schematic diagram of the fastening block of the dumbbell main body fastened at the first weight adding structure and second lower fastening holes of the second weight adding structure according to the first embodiment of the present invention. FIG. 16 shows a schematic diagram of the fastening block of the dumbbell main body fastened at the first weight adding structure and second upper fastening holes of the second weight adding structure according to the first embodiment of the present invention.

As shown in FIG. 1 and FIG. 2, in the first embodiment of the present invention, an assembled dumbbell 900 does not occupy an overly large space, and allows a user to quickly and easily replace weight plates in adaptation to own training requirements and change weights. The assembled dumbbell 900 includes a dumbbell main body 1, a first weight adding structure 100 and a second weight adding structure 200.

As shown in FIG. 3A to FIG. 5, the dumbbell main body 1 is made of metal and can be directly lifted by a user for weight training. The dumbbell main body 1 includes two side boards 10 and 10*a*, a connecting shaft 20, a rotating unit 30 and a fastener 40. The two side boards 10 and 10*a* are rectangular boards and can be placed on any plane as desired. Hard plastic casings may also be provided according to requirements on the outside of the two side boards 10 and 10*a*, so as to prevent scratches caused by friction and impact between the two side boards 10 and 10*a* and the first weight adding structure 100 when the two side boards 10 and 10*a* are placed in the first weight adding structure 100. Each of the two side boards 10 and 10*a* includes a containing space 11, a side-board upper chute 12, a side-board lower chute 13, a plurality of fastening holes 14, two fastening blocks 15 and 15*a*, a weight indicator 16 and a dumbbell main body foolproof unit 17. The containing space 11 is an interlayer inside the rectangular board of each of the side boards 10 and 10*a*. The side-board upper chutes 12 are located on the inside of the rectangular boards of the side boards 10 and 10*a*. The side-board lower chutes 13 are located on the inside of the rectangular boards of the side boards 10 and 10*a*, and are located below the side-board upper chutes 12. The plurality of fastening holes 14 are located on the inside of the rectangular boards of the side boards 10 and 10*a*, and are located below the side-board lower chutes 13. The plurality of fastening holes 14 are arrange along an arc that regards the connecting shaft 20 as a center, and the plurality of fastening holes 14 are for fastening with the fastener 40. The two fastening blocks 15 and 15*a* are located in the containing space 11 can extend to the outside from the containing space 11 so as to be fastened with the first weight adding structure 100 and the second weight adding structure 200. One of the fastening blocks 15 is located above the other fastening block 15*a*, and the two fastening blocks 15 and 15*a* respectively face the left and right sides of the side boards 10 and 10*a*.

The weight indicator 16 is located on the inside of one of the side boards 10, and is located above the side-board upper chute 12. The weight indicator 16 is a plurality of numerical indications arranged along an arc, a smallest number of the plurality of numerical indications is 0, and the plurality of numbers of the weight indicator 16 are for displaying the adjustable weight of the dumbbell main body 1. Positions of the plurality of numerical indications correspond to the plurality of fastening holes 14 by regarding the connecting shaft 20 as a center. For example, the number 0 on the leftmost of the weight indicator 16 corresponds to the rightmost fastening hole 14 of the plurality of fastening holes 14, and the number 1 on the second leftmost of the weight indicator 16 corresponds to the second rightmost fastening hole 14 of the plurality of fastening holes 14. However, the weight indicator 16 is not limited to being one in quantity, and the quantity may be modified to two that are respectively disposed on the inside of the two side boards 10 and 10*a*. As shown in FIG. 3A, FIG. 3B and FIG. 6, the dumbbell main body fool proof units 17 are screws and are located on the outside of the corresponding side boards 10 and 10*a*. However, the smallest number of the plurality of numerical indications is not limited to being 0, and the number may be modified according to application requirements, for example, modified to a corresponding number (for example, 10 pounds, 6 kilograms, and the like) in adaption to the weight of the dumbbell main body 1.

As shown in FIG. 1, FIG. 3A and FIG. 3B, the connecting shaft 20 is a cylinder for a user to hold and lift the dumbbell main body 1 for workout, and two ends of the connecting shaft 20 are respectively connected to the two side boards 10 and 10*a*. The rotating unit 30 includes two rotating rings 31, four connecting boards 32 and 32*a*, four sliding rods 33, four connecting board chutes 34 and a horizontal connecting board 35. The two rotating rings 31 are respectively pivoted on the two ends of the connecting shaft 20 and are respectively located on the two side boards 10 and 10*a*, and the two rotating rings 31 are for rotating relative to the connecting shaft 20. The four connecting boards 32 and 32*a* are respectively connected to the two rotating rings 31, wherein the two connecting boards 32 are located above the other two connecting boards 32*a*. The four connecting boards 32 and 32*a* are parallel to one another. One of the connecting boards 32 located next to the weight indicator 16 further includes an indication end 321. The indication end 321 is directed toward the weight indicator 16, and is for indicating the weight to which the dumbbell main body 1 is currently being adjusted.

As shown in FIG. 3A to FIG. 5, the four connecting board chutes 34 are respectively disposed at the four connecting boards 32 and 32*a*. The four sliding rods 33 are respectively disposed at the four connecting boards 32 and 32*a*. The four sliding rods 33 are respectively located at the four connecting board chutes 34, respectively located at the side-board upper chutes 12 and the side-board lower chutes 13 of the two side boards 10 and 10*a*, and respectively connected to the two fastening blocks 15 and 15*a* of the two side boards 10 and 10*a*. Thus, each of sliding rods 33 is capable of sliding at the same time along the connecting board chute 34, the side-board upper chute 12 and the side-board lower chute 13. When each of the sliding rod 33 slides in the side-board upper chute 12 and the side-board lower chute 13, the sliding rod 33 currently sliding pushes the two fastening blocks 15 and 15*a*, such that the two fastening blocks 15 and 15*a* extend out of or are withdrawn into the containing space 11. Two ends of the horizontal connecting board 35 are respectively connected to the other two connecting boards 32*a*.

As shown in FIG. 4A to FIG. 5, the fastener 40 is connected to the horizontal connecting board 35, and is for fastening with any of the fastening holes 14. The fastener 40 further includes a spring 41, a baffle 42, a push piece 43 and a protruding column 44. The spring 41 is for providing an elastic force to push the push piece 43 and the protruding column 44. The baffle 42 is connected to the connecting board 35 and one end of the spring 41. The push piece 43 is connected to the other end of the spring 41, and is to be triggered by a user so as to release the fastening between the fastener 40 and the fastening hole 14. The protruding column 44 is connected to the push piece 43, and is to be pushed by the spring 41 so as to be fastened with any of the fastening holes 14. The fastener 40 is not limited to being one in quantity, and may be modified to be two in quantity that respectively face the two side boards 10 and 10*a* so as to be respectively fastened with any of the fastening holes 14 of the corresponding side boards 10 and 10*a*.

When the rotating unit 30 rotates such that the indication end 321 points toward any of the numerical indications of the weight indicator 16, the rotating unit 30 simultaneously drives the horizontal connecting board 35 to rotate so that the fastener 40 connected to the horizontal connecting plate 35 moves to align with one of the fastening holes 14, and the fastening hole 14 corresponds, by regarding the connecting shaft 20 as a center, to the any of the numerical indications pointed by the indication end 321. When the rotating unit 30 rotates such that the indication end 321 points to any numerical indication that is non-0 of the weight indicator 16, the rotating unit 30 simultaneously drives the four sliding rods 33 to respectively move in the side-board upper chutes 12 and the side-board lower chutes 13 of the two side boards 10, so that the two fastening blocks 15 and 15*a* of the two side boards 10 connected to the four sliding rods 33 extend to the outside from the containing space 11.

As shown in FIG. 7 to FIG. 9, the first weight adding structure 100 is for joining with the dumbbell main body 1 so as to increase the overall weight for a user to carry out weight training. The first weight adding structure 100 is made of metal, and includes two first sidewalls 110, a first upper connecting board 120 and a first lower connecting board 130. The two first sidewalls 110 appear as rectangular boards, and can be placed on any plane as desired, and the dumbbell main body 1 can be placed between the two first sidewalls 110. Each of the first sidewalls 110 further includes a first notch 111 and a first foolproof unit 112. The position of the first notch 111 corresponds to the dumbbell main body foolproof unit 17. When the dumbbell main body 1 is placed between the two first sidewalls 110 such that the dumbbell main body 1 is joined with the first weight adding structure 100, the dumbbell main body foolproof unit 17 are respectively located in the first notches 111. Thus, it is ensured that the dumbbell main body 1 is placed between the two first sidewalls 110 in a correct direction. The first fool proof unit 112 is a screw and is located on the outside of the corresponding first sidewall 110.

As shown in FIG. 7, FIG. 9 and FIG. 12, the first upper connecting board 120 connects the two first sidewalls 110. The first upper connecting board 120 includes two first upper fastening holes 121, the two first upper fastening holes 121 respectively correspond to two of the fastening blocks 15 located above, and the two first upper fastening holes 121 are for respectively fastening with the two of the fastening blocks 15. As shown in FIG. 7, FIG. 10 and FIG. 11, the lower upper connecting board 130 is connected to two first sidewalls 110. The first lower connecting board 130 includes two first lower fastening holes 131, the two first lower fastening holes 131 respectively correspond to other two of the fastening blocks 15*a* located below, and the two first lower fastening holes 131 are for respectively fastening with the two of the fastening blocks 15*a*.

As shown in FIG. 9 to FIG. 12, when the dumbbell main body 1 is located between the two first sidewalls 110 and the two fastening blocks 15 and 15*a* of the two side boards 10 extend to the outside from the containing space 11, the two fastening blocks 15 and 15*a* of the two side boards 10 respectively pass through the two first upper fastening holes 121 of the first upper connecting board 120 and the two first lower fastening holes 131 of the first lower connecting board 130 of the two first sidewalls 110, such that the dumbbell main body 1 is joined with the first weight adding structure 100.

As shown in FIG. 13 to FIG. 16, the second weight adding structure 200 is for joining with the dumbbell main body 1 and the first weight adding structure 100 so as to increase the overall weight for a user to carry out weight training. The second weight adding structure 200 is made of metal, and includes two second sidewalls 210, a second upper connecting board 220 and a second lower connecting board 230. The two second sidewalls 210 appear as rectangular boards, and can be placed on any plane as desired, and the dumbbell main body 1 and the first weight adding structure 100 can be placed between the two second sidewalls 210. Each of the second sidewalls 210 further includes a second notch 211 and a second foolproof unit 212. Position of the second notch 211 corresponds to the first foolproof unit 112. When the dumbbell main body 1 and the first weight adding structure 100 are placed between the two second sidewalls 210 such that the dumbbell main body 1 is joined with the first weight adding structure 100 and the second weight adding structure 200, the first foolproof unit 112 are respectively located in the second notches 211. Thus, it is ensured that the first weight adding body 100 is placed between the two second sidewalls 210 in a correct direction. The second fool proof unit 212 is a screw and is located on the outside of the corresponding second sidewall 210.

The second upper connecting board 220 connects to two second sidewalls 210. The second upper connecting board 220 includes two second upper fastening holes 221, the two second upper fastening holes 221 respectively correspond to two of the fastening blocks 15 located above and the two first upper fastening holes 121, and the two second upper fastening holes 221 are for respectively fastening with the two of the fastening blocks 15. The second lower connecting board 230 connects the two second sidewalls 210. The second lower connecting board 230 includes two second lower fastening holes 231, the two second lower fastening holes 231 respectively correspond to two of the fastening blocks 15*a* located below and the two first lower fastening holes 131, and the two second lower fastening holes 231 are for respectively fastening with the two of the fastening blocks 15*a*.

When the dumbbell main body 1 is located between the two first sidewalls 110, the first weight adding structure 100 is located between the two second sidewalls 210, and when the two fastening blocks 15 and 15*a* of the two side boards 10 pass through the two first upper fastening holes 121 and the two first lower fastening holes 131 from the containing space 11 and extend to the outside, the two fastening blocks 15 and 15*a* of the two side boards 10 respectively pass through the two second upper fastening holes 221 of the second upper connecting board 220 and the two second lower fastening holes 231 of the second lower connecting board 230 of the two second sidewalls 210, such that the dumbbell main body 1 is joined with the first weight adding structure 100 and the second weight adding structure 200.

As shown in FIG. 3A, if the user wishes for workout by using only the dumbbell main body 1, the connecting shaft 20 can be held by hands so as to lift the dumbbell main body 1 for workout. If the user wishes to increase the intensity of workout, as shown in FIG. 8 and FIG. 9, the user may place the dumbbell main body 1 between the two first sidewalls 110, such that the foolproof unit 17 are respectively located in the first notches 111. Thus, it is ensured that the dumbbell main body 1 is placed between the two first sidewalls 110 in a correct direction. Next, as shown in FIG. 4A and FIG. 4B, the user may trigger the push piece 43 to disengage the protruding column 44 from the fastening hole 14. At this point, the fastening between the fastener 40 and the fastening hole 14 is released and the position of the horizontal connecting board 35 is no longer fixed. Thus, the user may apply a force on the horizontal connecting board 35 to rotate the rotating unit 30. At this point, as shown in FIG. 11 and FIG. 12, the user may rotate the rotating unit 30 such that the indication end 321 points to the numerical indication 1 of the weight indicator 16, enabling the rotating unit 30 to simultaneously drive the four sliding rods 33 to respectively move in the side-board upper chutes 12 and the side-board lower chutes 13 of the two side boards 10, so that the two fastening blocks 15 and 15*a* of the two side boards 10 connected to the four sliding rods 33 extend to the outside from the containing space 11. The two fastening blocks 15 and 15*a* of the two side boards 10 extending to the outside from the containing space 11 respectively pass through the two first upper fastening holes 121 of the first upper connecting board 120 and the two first lower fastening holes 131 of the first lower connecting board 130 of the two first sidewalls 110, such that the dumbbell main body 1 is joined with the first weight adding structure 100. Lastly, the user may release the push piece 43 to allow the spring 41 to push the protruding column 44, such that the protruding column 44 extends into the fastening hole 14 corresponding to the numerical indication 1 of the weight indicator 16 and be mutually fixed, thus fixing the position of the fastener 40. Thus, the rotating unit 30 connected to the fastener 40 and the sliding rod 33 connected thereto are also positioned, accordingly also positioning the fastening blocks 15 and 15*a* respectively connected to the sliding rods 33, and stably joining the two fastening blocks 15 and 15*a* with the first weight adding structure 100. As such, the overall weight of the assembled dumbbell 900 is further increased, and so the user may hold the connecting shaft 20 so as to lift the dumbbell main body 1 and the first weight connecting structure 100 for workout.

If the user wishes to further increase the intensity of workout, as shown in FIG. 1, FIG. 15 and FIG. 16, the user may place the dumbbell main body 1 between the two first sidewalls 110, and then place the first weight adding structure 100 between the two second sidewalls 210, such that the dumbbell main body foolproof unit 17 are respectively located in the first notches 111 and the first foolproof units 112 are respectively located in the second notches 211. Thus, it is ensured that the dumbbell main body 1 is placed between the two first sidewalls 110 in a correct direction, and that the first weight adding structure 100 is placed between the two second sidewalls 210 in a correct direction. Next, as shown in FIG. 4A and FIG. 4B, the user may trigger the push piece 43 to disengage the protruding column 44 from the fastening hole 14. At this point, the fastening between the fastener 40 and the fastening hole 14 is released and the position of the horizontal connecting board 35 is no longer fixed. Thus, the user may apply a force on the horizontal connecting board 35 to rotate the rotating unit 30. At this point, as shown in FIG. 5, FIG. 15 and FIG. 16, the user may rotate the rotating unit 30 such that the indication end 321 points to the numerical indication 2 of the weight indicator 16, enabling the rotating unit 30 to simultaneously drive the four sliding rods 33 to respectively move in the side-board upper chutes 12 and the side-board lower chutes 13 of the two side boards 10, so that the two fastening blocks 15 and 15*a* of the two side boards 10 connected to the four sliding rods 33 extend to the outside from the containing space 11. The two fastening blocks 15 and 15*a* extending to the outside from the containing space 11, the two first upper fastening holes 121 and the two first lower fastening holes 131 respectively pass through the two second upper fastening holes 221 of the second upper connecting board 220 and the two second lower fastening holes 231 of the second lower connecting board 230 of the two second sidewalls 210, such that the dumbbell main body 1 is joined with the first weight adding structure 100 and the second weight adding structure 200. Lastly, the user may release the push piece 43 to allow the spring 41 to push the protruding column 44, such that the protruding column 44 extends into the fastening hole 14 corresponding to the numerical indication 2 of the weight indicator 16 and be mutually fixed, thus fixing the position of the fastener 40. Thus, the rotating unit 30 connected to the fastener 40 and the sliding rod 33 connected thereto are also positioned, accordingly also positioning the fastening blocks 15 and 15*a* respectively connected to the sliding rods 33, and stably joining the two fastening blocks 15 and 15*a* with the first weight adding structure 100 and the second weight adding structure 200. As such, the overall weight of the assembled dumbbell 900 is further increased, and so the user may hold the connecting shaft 20 so as to lift the dumbbell main body 1, the first weight connecting structure 100 and the second weight adding structure 200 for workout.

It should be noted that, in the description of the assembled dumbbell 900 of the present invention, the dumbbell main body 1 can be additionally joined with the first weight adding structure 100 and the second weight adding structure 200. However, in practice, more weight adding structures having larger volumes can be designed in accordance with the structures of the first weight adding structure 100 and the second weight adding structure 200. Thus, the overall weight of the assembled dumbbell 900 can be further increased according to weight requirements of the user for workout.

With the structural design of the assembled dumbbell 900 and the dumbbell main structure 1 of the present invention, the assembled dumbbell 900 does not occupy an overly large space, and a user can quickly extend or withdraw the fastening blocks by using the rotating unit so as to quickly join the first weight adding structure and the second weight adding structure to change the weight in adaption to own training requirements. With human actual testing on the present invention, the process of operating the rotating unit to quickly extend or withdraw the fastening blocks and combine with another weight increasing structure takes only 1 to 2 seconds, and such operation process is easy and quick for the user.

It should be noted that, the embodiments given above are examples of the present invention rather than limitations to the present invention. Any variation without departing from the fundamental structure of the invention is to be encompassed within the scope of protection in accordance with the broadest interpretation of the appended claims of the application.

What is claimed is:

1. A dumbbell main body, comprising:

two side boards, each of the two side boards comprising a containing space, a side-board upper chute, a side-board lower chute, a plurality of fastening holes and two fastening blocks, wherein one of the fastening blocks is located above the other fastening block;

a connecting shaft, two ends of the connecting shaft respectively connected to the two side boards;

a rotating unit, comprising:

two rotating rings, respectively pivoted to the two ends of the connecting shaft;

four connecting boards, respectively connected to the two rotating rings, wherein two of the connecting boards are located above the other two connecting boards;

four sliding rods, respectively disposed at the four connecting boards, respectively located at the side-board upper chutes and the side-board lower chutes of the two side boards, and respectively connected to the two fastening blocks of the two side boards; and a horizontal connecting board, two ends of the horizontal connecting board respectively connecting the other two connecting boards; and a fastener, connected to the horizontal connecting board, for fixing with any of the fixing holes.

2. The dumbbell main body according to claim 1, wherein the fastener further comprises:

a spring;

a baffle, connected to one end of the spring;

a push piece, connected to one other end of the spring; and a protruding column, connected to the push piece, for fixing with any of the fixing holes.

3. The dumbbell main body according to claim 2, wherein one of the side boards comprises a weight indicator, which is located above the side-board upper chute and is located above one of the connecting boards.

4. The dumbbell main body according to claim 3, wherein the weight indicator is a plurality of numerical indications arranged along an arc, a smallest number of the plurality of numerical indications is 0, the plurality of fastening holes are arranged along an arc, and positions of the plurality of numerical indications correspond to the plurality of fastening holes by regarding the connecting shaft as a center.

5. The dumbbell main body according to claim 4, wherein the rotating unit further comprises four connecting board chutes, the four connecting board chutes are respectively disposed at the four connecting boards, and the four sliding rods are respectively located at the four connecting board chutes.

6. The dumbbell main body according to claim 5, wherein one of the connecting boards further comprises an indication end, which is directed toward the weight indicator.

7. The dumbbell main body according to claim 6, wherein the four connecting boards are parallel to one another.

8. The dumbbell main body according to claim 7, wherein when the rotating unit rotates such that the indication end points toward any of the numerical indications of the weight indicator, the rotating unit simultaneously drives the horizontal connecting board to rotate so that the fastener connected to the horizontal connecting plate moves to align with one of the fastening holes, and the fastening hole corresponds, by regarding the connecting shaft as a center, to the any of the numerical indications pointed by the indication end.

9. The dumbbell main body according to claim 8, wherein when the rotating unit rotates such that the indication end points to any numerical indication that is non-0 of the weight indicator, the rotating unit simultaneously drives the four sliding rods to respectively move in the side-board upper chutes and the side-board lower chutes of the two side boards, so that the two fastening blocks of the two side boards connected to the four sliding rods extend to an outside from the containing space.

10. An assembled dumbbell, comprising:

the dumbbell main body according to claim 1; and a first weight adding structure, comprising:

two first sidewalls, between which the dumbbell main body is located;

a first upper connecting board, connecting the two first sidewalls and comprising two first upper fastening holes, the two first upper fastening holes respectively corresponding to one of the fastening blocks of the two side boards located above; and a first lower connecting board, connecting the two first sidewalls and comprising two first lower fastening holes, the two first lower fastening holes respectively corresponding to one other of the fastening holes of the two side boards located below.

11. The assembled dumbbell according to claim 10, wherein when the dumbbell main body is located between the two first sidewalls and the two fastening blocks of the two side boards extend to an outside from the containing space, the two fastening blocks of the two side boards respectively pass through the two first upper fastening holes of the first upper connecting board and the two first lower fastening holes of the first lower connecting board of the two first sidewalls, such that the dumbbell main body is joined with the first weight adding structure.

12. The assembled dumbbell according to claim 11, wherein each of the side boards further comprises a dumbbell main body foolproof unit that is located on an outside of the side board, each of the first sidewalls further comprises a first notch, a position of the first notch corresponds to the dumbbell main body foolproof unit, and the dumbbell main body foolproof unit is located in the first notch when the dumbbell main body is joined with the first weight adding structure.

13. The assembled dumbbell according to claim 11, further comprising:

a second weight adding structure, comprising:

two second sidewalls;

a first second upper connecting board, comprising two second upper fastening holes, the two second upper fastening holes respectively corresponding to two of the fastening blocks located above and the two first upper fastening holes; and a second lower connecting board, comprising two second lower fastening holes, the two second lower fastening holes respectively corresponding to other two of the fastening blocks located below and the two first lower fastening holes.

14. The assembled dumbbell according to claim 13, wherein when the dumbbell main body is located between the two first sidewalls, the first weight adding structure is located between the two second sidewalls, and the two fastening blocks of the two side boards extend to the outside from the containing space, the two first upper fastening holes and the two first lower fastening holes, the two fastening blocks of the two side boards respectively pass through the two second upper fastening holes of the second upper connecting board and the two second lower fastening holes of the second lower connecting board of the two second sidewalls, such that the dumbbell main body is joined with the first weight adding structure and the second weight adding structure.

15. The assembled dumbbell according to claim 14, wherein each of the first sidewalls further comprises a first foolproof unit which is located on an outside of the first sidewall, each of the second sidewalls further comprises a second notch corresponding in position to the first foolproof unit, and the first foolproof unit is located in the second notch when the first weight adding structure is joined with the second weight adding structure.

* * * * *